US009909372B2

(12) United States Patent
Jewett

(10) Patent No.: US 9,909,372 B2
(45) Date of Patent: Mar. 6, 2018

(54) WELL CASING STOP COLLAR

(71) Applicant: PORTABLE COMPOSITE STRUCTURES, INC., Irvine, CA (US)

(72) Inventor: Scott E. Jewett, Irvine, CA (US)

( * ) Notice: Subject to any disclaimer, the term of this patent is extended or adjusted under 35 U.S.C. 154(b) by 268 days.

(21) Appl. No.: 15/046,089

(22) Filed: Feb. 17, 2016

(65) Prior Publication Data

US 2016/0273277 A1 Sep. 22, 2016

Related U.S. Application Data

(60) Provisional application No. 62/134,115, filed on Mar. 17, 2015.

(51) Int. Cl.
*E21B 17/10* (2006.01)

(52) U.S. Cl.
CPC ..... *E21B 17/1078* (2013.01)

(58) Field of Classification Search
CPC ..... E21B 17/1078; E21B 17/10–17/12
See application file for complete search history.

(56) References Cited

U.S. PATENT DOCUMENTS

| | | | |
|---|---|---|---|
| 4,694,939 | A | 9/1987 | Heideman et al. |
| 5,165,473 | A | 11/1992 | Bode |
| 5,706,894 | A | 1/1998 | Hawkins, II |
| 6,533,034 | B1 | 3/2003 | Barger |
| 8,074,712 | B2 | 12/2011 | Olsen et al. |
| 8,832,906 | B2 | 9/2014 | Buytaert et al. |

*Primary Examiner* — George S Gray
(74) *Attorney, Agent, or Firm* — David G. Duckworth

(57) ABSTRACT

A stop collar for pipes or shafts is provided for restricting objects from sliding lengthwise along the length of a pipe or shaft. The stop collar is ring-shaped and includes a leading edge which is angled from perpendicular to the pipe's longitudinal axis. The angled leading edge provides the leading edge with a proximal engagement point and a distal engagement point. Longitudinal force on the distal engagement point, by an object such as a tool or sensor, causes the stop collar to cock relative to the pipe or shaft. This cocking of the stop collar effects a braking function to prevent the stop collar from sliding longitudinally along the pipe.

12 Claims, 8 Drawing Sheets

WELL CASING STOP COLLAR

RELATED APPLICATIONS

The present application claims priority under 35 U.S.C. Section 119 from U.S. Provisional Patent Application Ser. No. 62/134,115 filed on Mar. 17, 2015. The contents of the aforementioned application are incorporated by reference herein.

BACKGROUND OF THE INVENTION

The invention relates to devices which grip tubular members, such as a drill pipe. More particularly, the invention relates to locking collars for positioning and affixing objects to a drill pipe.

In the field of oil well drilling, various tools and appliances, such as centralizers, scratchers, solidifiers, baskets, and the like, have been developed for centering the casing within the wellbore or for cleaning or otherwise scraping the walls of the bore to facilitate the placing of the cement column around the casing and to assure a satisfactory bonding of the column to the wall of the well. In addition, various tools and sensors must be located downhole in a wellbore which are typically mounted upon the well casing.

Well drilling is a time consuming and expensive operation. Costs and manpower require that every operation be completed as quickly and efficiently as possible. Thus, downhole tools and sensors must be positioned and locked upon a pipe casing as quickly as possible.

"Locking collars", also known as "stop collars", have been used for centuries to hold objects and prevent them from sliding longitudinally upon an elongate object such as a pipe or rod. A wide variety of fasteners have been employed to affix stop collars upon the casing, ranging from welding, or friction fits using bolts, setscrews, or wedging pin arrangements. Additional structures to prevent the stop collar from moving longitudinally upon the casing including the use of knockdown buckles or low friction surfaces such as teeth.

Fasteners are often time consuming to install, and require torque measurement or other methods to assure adequate resistance to longitudinal sliding. For example, each buckle of a knockdown buckle must be hammered against the well casing for proper engagement. Further, aside from welding which is cost and time prohibitive, all fastener constructions risk longitudinal sliding due to vibration or other forces. If forced to slide, setscrews, bolts and wedges can score the casing reducing its integrity which can cause failure burst, leaking or deformation.

Previous stop collars have a perpendicular leading edge so that longitudinal force creates an even sliding force on the stop collar. This sliding force can overcome the friction from set screws, wedges or other tightening means causing stop collars to slide. Further, this sliding can cause set screws or wedges to score or damage a pipe or shaft, thus reducing its integrity. Pipe integrity is critical in many installations such as oil pipelines, hydraulics and other high-performance applications.

Therefore, there remains a need for a stop collar that allows for the positioning of downhole tools, sensors and other objects that may be installed quickly and easily.

There is also a need for a stop collar that is not subject to disengagement due to vibration and other similar forces.

Furthermore, there is a need for a stop collar with a minimum of components to facilitate installation and decrease the probability of failure.

SUMMARY OF THE INVENTION

A stop collar is provided which includes an annular body having an inner diameter sized to receive a pipe, rod, well casing or other elongate object having a circular cross-section. For simplicity, the stop collar is described herein for affixing to a well pipe, also referred to as a casing, but it is not intended to be limited to such an assembly unless specifically stated.

The stop collar has two edges, identified herein as a leading edge and a trailing edge. The terms "leading edge" and "trailing edge" are intended for reference and illustration only with the term "leading edge" referring to the stop collar edge which is intended to engage a tool or sensor, or first engage a wellbore sidewall as the stop collar is transported downhole. However, the stop collar may be utilized for various purposes and configurations such as where the trailing edge engages a tool or sensor, and thus the terms are not intended to be so limiting. Further, directional terms such as "upper", "lower", "above", "below", "top", "bottom" and the like are being used to illustrate a relational location, and are not intended to limit the invention.

Unlike previous stop collars, the stop collar of the present invention does not have a perpendicular leading edge. Instead, the stop collar's leading edge is angled at least a few degrees from perpendicular. The angle of the leading edge provides the stop collar with a projecting region having a distal engagement point anticipated to engage a tool, sensor, or wellbore obstruction, and a proximal engagement point anticipated to engage the pipe sidewall in the event that the stop collar is cocked. Advantageously, this results in the stop collar being self-tightening in the event that the stop collar engages an object (such as a tool, sensor or obstruction) as the stop collar is slid down a bore such as a well hole. Specifically, instead of the collar engaging an object substantially uniformly on opposite sides as would be the case for a traditional stop collar, only the stop collar's distal engagement point engages the object. Engagement of the stop collar's angled leading edge only at the distal engagement point isolates longitudinal force onto one radial spot. This force on the distal engagement point results in the stop collar cocking due to the inherent discrepancy between the outer diameter of the casing and the inner diameter of stop collar until the stop collar's proximal engagement point engages the pipe. This cocking causes the collar edges to dig into the pipe or shaft, braking it against longitudinal movement. Thus, the angled leading edge converts longitudinal force exerted by the object into gripping force.

In a preferred embodiment, the leading edge is angled between 1° to 45° from perpendicular. In more preferred embodiments, the leading edge is angled 1° to 10° from perpendicular. Even more particularly, the angle of the leading edge is sufficient that its engagement with a ring shaped object having a uniform perpendicular surface, such as a ring, tool or sensor, will cause the stop collar to cock, but not cock so much that the stop collar's leading edge comes in complete contact with the ring-shaped object. As would be understood by those skilled in the art, the angle of the leading edge would be dependent on the annular space between the stop collar and the pipe. An increase in the annular space increases the capability of the stop collar to cock prior to the stop collar engaging the pipe sidewall, thereby requiring the leading edge to have greater angle from perpendicular. Conversely, a decrease in the annular space between the stop collar and the pipe decreases the capability of the stop collar to cock prior the stop collar's proximal engagement point engaging the pipe sidewall. Thus, the leading edge's angle is dependent on the exterior diameter or the pipe, the interior diameter of the stop collar, and the resulting annular space between the two.

Installation of the stop collar to a pipe or shaft can be accomplished using various fasteners known to those skilled in the art including clamps, compression rings, set screws, or even a press-fit attachment wherein the stop collar's inner diameter is the same or slightly smaller than the pipe's exterior diameter. The stop collar may be a solid ring which is slid over the end of the pipe and secured in place by various fasteners such as threaded set screws. In alternative embodiments, the stop collar may be affixed to a casing by including a hinged opening. For installation of hinged stop collars, the collar body is constructed of two or more sections which encircle a pipe or shaft. The sections are locked together by a collar hinge. Preferably, the collar hinge includes a locking pin within a dovetailed closure joint with the sections configured to create a ring around the pipe or shaft. Preferably, the hinged collar and pipe are sized so that when the hinge pin is driven into a dovetail joint, the collar will tighten the collar around the pipe to provide a press-fit engagement with the collar affecting a clamping force on the pipe or shaft.

The tightening force may be created by either a sloped geometry within the holes in dovetailed closure joint and/or by providing the locking pin with a tapered end. Alternatively, the dovetailed closure joint can have sloped interlocking surfaces so that the dovetailed closure joint self-tightens the collar around the pipe or shaft.

Additionally, set screws can be employed to tighten the stop collar on a pipe or shaft. Preferably, the set screws extend through female holes formed through the collar's sidewall and the set screws are positioned such that longitudinal force upon the collar's distal engagement point causes the collar to cock and the proximal engagement point to dig into pipe or shaft. To this end, it is preferred that the one or more set screws are positioned midway between the collar's proximal engagement point and the distal engagement point so that force upon the distal engagement point causes the collar to cock and the collar's proximal engagement point to dig into the pipe, creating a locking or braking result.

In operation, when exposed to a longitudinal force from an object around pipe or shaft, the object will make contact with the stop collar's distal engagement point. This local longitudinal force tends to rotate the stop collar out of concentric alignment with the pipe causing the collar's proximal engagement point to dig into the pipe. This effectively converts longitudinal sliding force into braking force.

Advantageously, increased longitudinal force exerted upon the stop collar creates increased braking force.

These and other more specific objects and advantages of the invention will be apparent to those skilled in the art from the following description taken in conjunction with the drawings.

DETAILED DESCRIPTION OF THE PREFERRED EMBODIMENTS

Figure 1A:
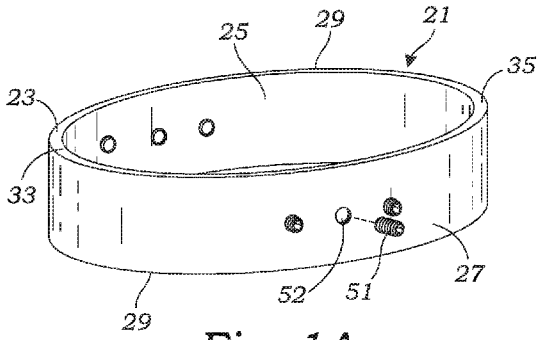
FIG. 1A is a perspective view of the stop collar of the present invention.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

With reference to FIGS. 1A-8B, the pipe and collar assembly 1 incorporates a pipe 3 and a stop collar 21. The pipe 3 has a traditional elongate annular construction including a circular sidewall 5 forming a central conduit 7 which defines the pipe's longitudinal axis. Meanwhile, the stop collar 21 includes a ring-shaped body 23 having a center hole. The stop collar's ring-shaped body has an exterior surface 9, and an interior surface 25 with a diameter the same or slightly larger than the pipe's exterior diameter. In addition, the stop collar 21 has two opposed ends referred to herein as a leading edge 29 and a trailing edge 31.

Figure 1C:
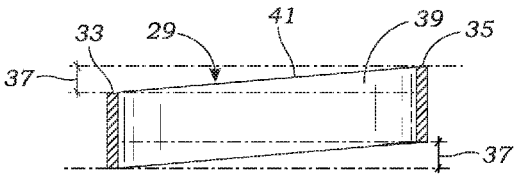
FIG. 1C is a side cutaway view of the stop collar of the present invention.
Figure 1B:
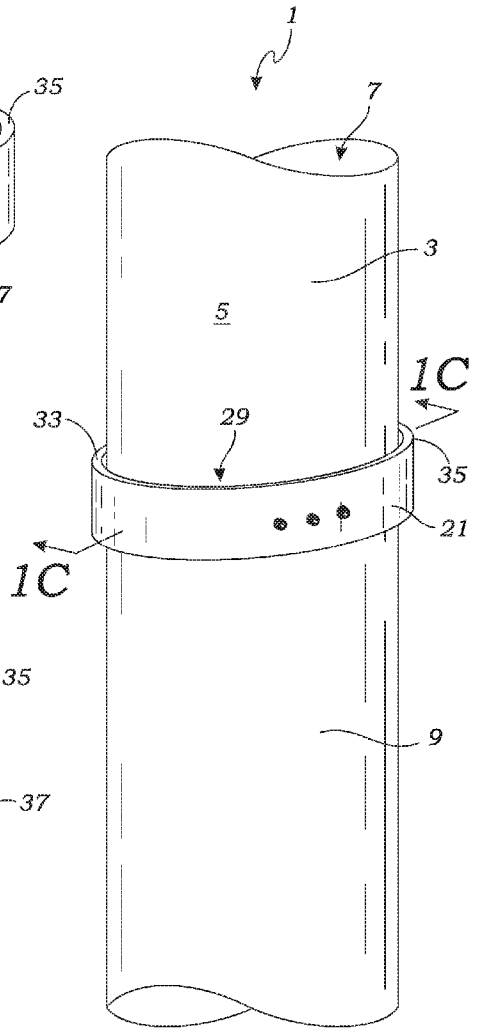
FIG. 1B is a perspective view of a pipe and collar assembly of the present invention.

With reference to FIGS. 1A-1C, the stop collar's leading edge 29 includes a projecting region 39 so as to provide the leading edge with a proximal engagement point 33 and a distal engagement point 35. The distal engagement point is positioned longitudinally distal relative to the leading edge's proximal engagement point 33 so that when the stop collar's leading edge engages a tool, sensor or other object, the distal engagement point 35 would engage such object prior to the proximal engagement point engaging such object. Due to the longitudinal distance between the proximal engagement point 33 and distal engagement point 35, the stop collar's leading edge 29 is angled 37 at least a few degrees from perpendicular. As illustrated in the drawings, preferably this angled edge section 41 which extends from the proximal engagement point 33 to the distal engagement point 35 is relatively straight. However, the term "angled" is intended to be interpreted broadly as the angled edge section 41 may be curved or even incorporate minor projections or even short perpendicular portions. However, as explained in greater detail below, it is important that the distal engagement point 35 be sufficiently displaced longitudinally from the rest of the leading edge 29 so as to allow the stop collar 21 to cock when the stop collar's distal engagement point 35 comes in contact with an object.

The stop collar assembly can be configured in any number of manners. In a first embodiment illustrated in FIGS. 1A, 1B and 1C, the stop collar assembly 1 includes a single stop collar 21. For this embodiment, both ends of the stop collar are angled at least a few degrees from perpendicular to the pipe's longitudinal access. Accordingly, either end of the stop collar could be construed to have a leading edge 29 or a trailing edge 31 depending on which edge is intended to engage an object. The stop collar 21 may be affixed to the pipe 3 by a press-fit engagement, clamps, wrap bands, wedges, compression rings, or welding. However, welding is not considered a preferred structure for affixing the stop collar 21 to the pipe 3 because cocking of the stop collar will cause the weld to break unless the weld is placed near the stop collar's proximal engagement point. As illustrated in FIGS. 1A-5B, a preferred structure for affixing the stop collar to a pipe includes the integration of one or more male threaded set screws 51 which threadably project through female threaded holes 52 formed through the stop collar's sidewall 23. Preferably, the set screws 51 are located at, or very near, the midpoint between the stop collar's proximal engagement point 33 and distal engagement point 35. Placement of the set screws at the midpoint provides a pivot point for the stop collar to cock when engaging a ring shaped object.

Figure 2A:
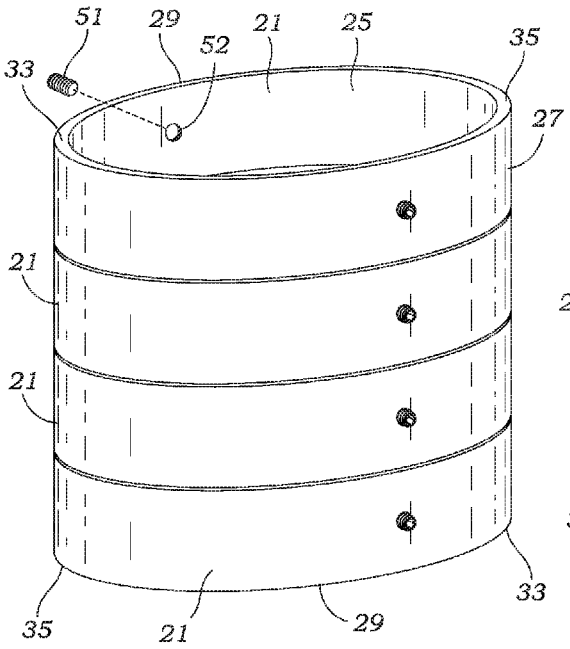
FIG. 2A is a perspective view illustrating four (4) stacked stop collars of the present invention.
Figure 2B:
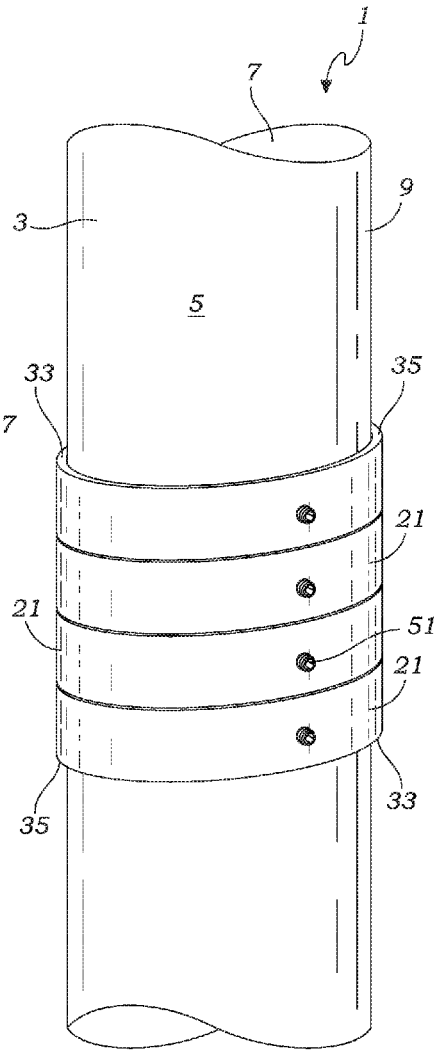
FIG. 2B is a perspective view of a pipe and collar assembly of the present invention illustrating the use of four (4) stop collars shown in FIG. 2A.

In an alternative embodiment illustrated in FIGS. 2A and 2B, the stop collar assembly includes four (4) stop collars 21, each with its own leading edge 29 and trailing edge 31. The stop collars are affixed to a pipe 3 utilizing set screws 51. Advantageously, engagement of the distally located stop collar to an object (not shown) will cause all (4) four stop collars to cock independently causing each of their proximal engagement points 33 to rotate so as to engage the pipe when force is exerted on the distal stop collar assembly's distal engagement point 35. The longitudinal force exuded on the distal stop collar's distal engagement point rotates all four (4) stop collars out of concentric alignment with the pipe causing each of the four (4) stop collar's proximal engagement points 33 to dig into the pipe's exterior surface 9.

Figure 3A:
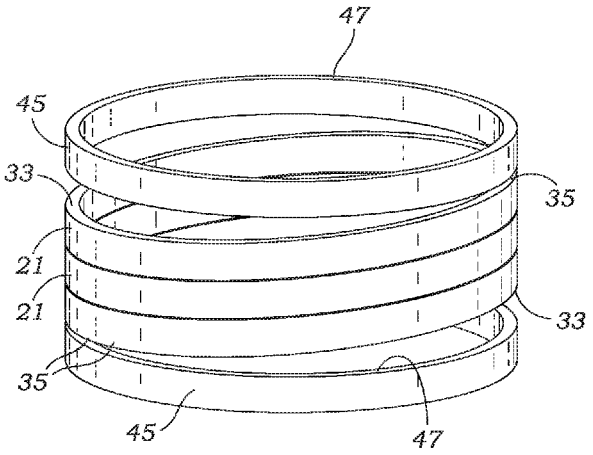
FIG. 3A is a perspective view illustrating a stop collar assembly including three (3) stop collars and a proximal ring and a distal ring.
Figure 3B:
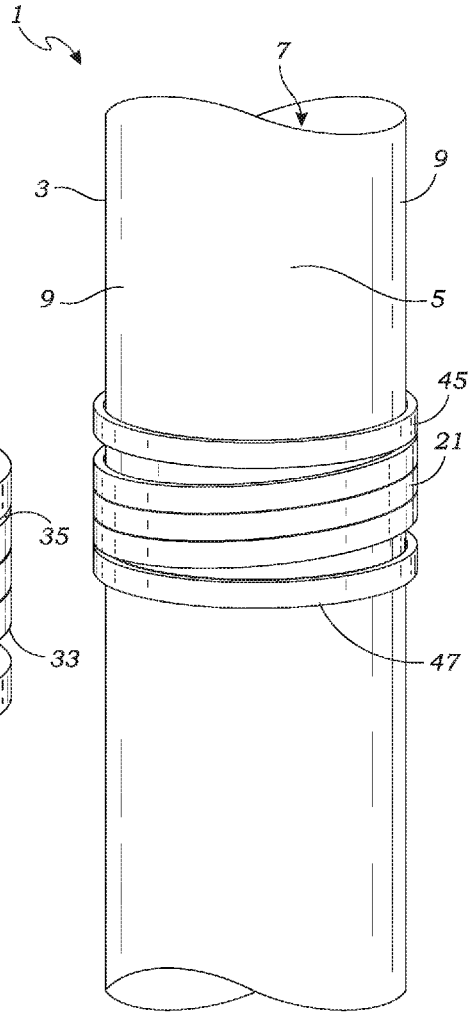
FIG. 3B is a perspective view of a pipe and stop collar assembly including the three (3) stop collars and two (2) rings shown in FIG. 3A.

In still an additional pipe and collar assembly illustrated in FIGS. 3A and 3B, the pipe and collar assembly 1 includes (3) three stop collars 21 similar in structure to the stop collar illustrated in FIGS. 1 and 2. In addition the stop collar assembly 1 includes a pair of rings 45. Each ring 45 has an annular structure similar to the stop collar 21. However, instead of having angled ends, the rings have opposed parallel edges 47 which are perpendicular to the pipe's longitudinal axis. A first "leading" edge of the ring engages a tool, sensor or other object which may or may not have a circular perpendicular edge. However, the opposing end of the ring engages the stop collar's distal engagement point 35 so as to ensure that the one or more stop collars, in this case (3) three, properly rotate so as to cause the stop collars' proximal engagement points to engage the pipe's exterior surface 9.

Figure 4A:
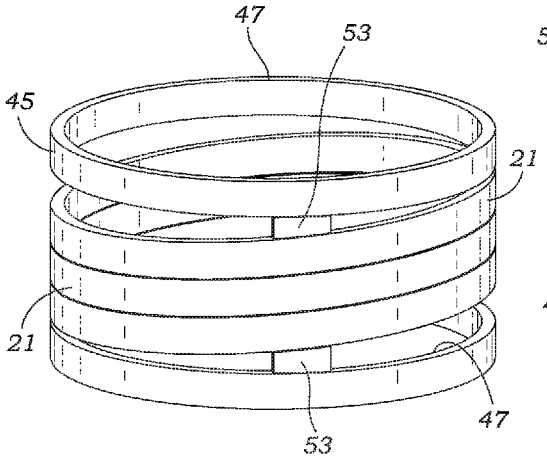
FIG. 4A is a perspective view of a stop collar assembly including three (3) stop collars positioned between two (2) rings including a pair of spacers.
Figure 4B:
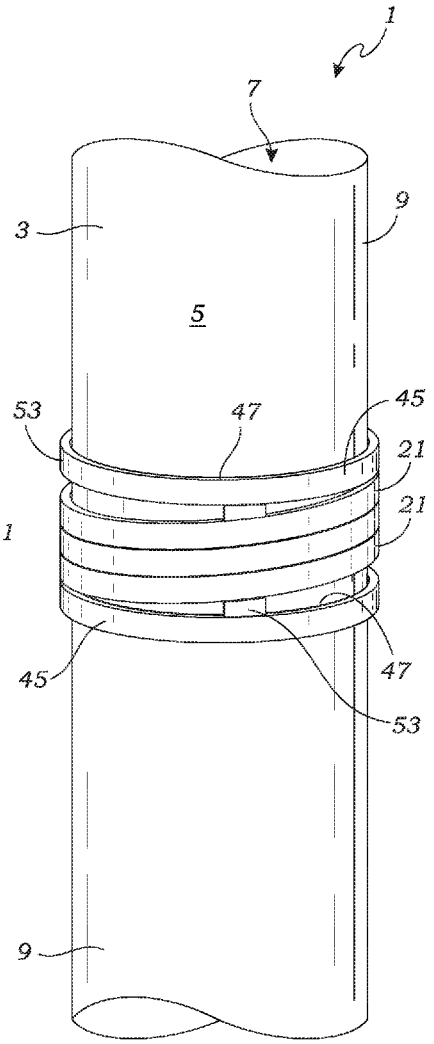
FIG. 4B is a perspective view of a pipe and collar assembly including the stop collars and rings shown in FIG. 4A.

As illustrated in FIGS. 4A and 4B, the stop collar assembly 1 may include spacers 53 positioned between the stop collars 21 and rings 45. Preferably the spacers 53 include an adhesive or other fastener so as to affix each ring 45 to an adjacent stop collar 21. Also preferably, each spacer 53 is made of a flexible or malleable material so as to easily compress when an object is forced against a ring 45. Though not illustrated in the figures, in still additional embodiments, the entire tapered space between a ring 45 and stop collar 21 may be filled with a plastic, rubber or other material so as to bind the rings and stop collars together.

Figure 5A:
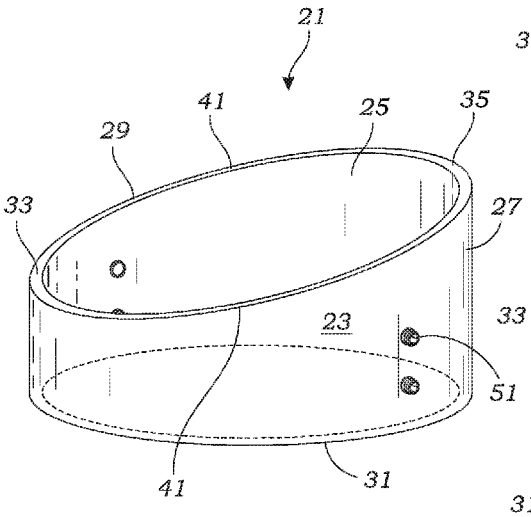
FIG. 5A is a perspective view illustrating a stop collar including a tapered leading edge and a perpendicular trailing edge.
Figure 5B:
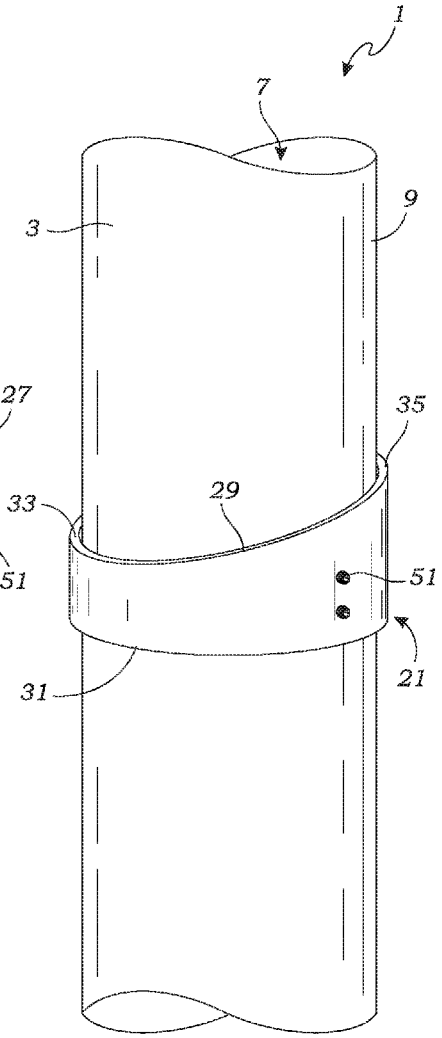
FIG. 5B is a perspective view illustrating a pipe and collar assembly including the stop collar shown in FIG. 5A.

With reference to FIGS. 5A and 5B, in still an additional embodiment of the pipe and collar assembly 1, the stop collar 21 has a single angled leading edge 29 and a trailing edge 31 perpendicular to the pipe 3. As in previously described embodiments, the stop collar's leading edge has a proximal engagement point 33 and a distal engagement point 35 providing the stop collar with a projecting region 39. As illustrated in FIGS. 5A and 5B, preferably the stop collar is affixed to a pipe 3 by set screws 31 located on opposite sides of the stop collar 21 intermediate to the stop collar's proximal engagement point 33 and distal engagement point 35.

Figure 6A:
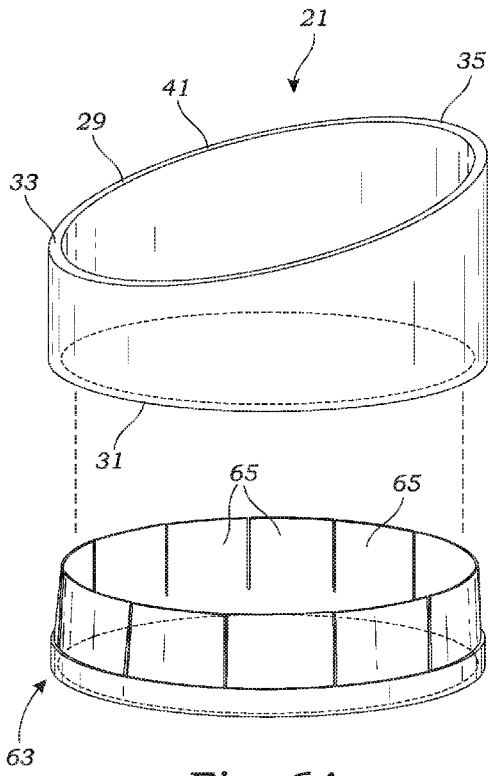
FIG. 6A is a perspective view illustrating a stop collar assembly incorporating a compression ring.
Figure 6B:
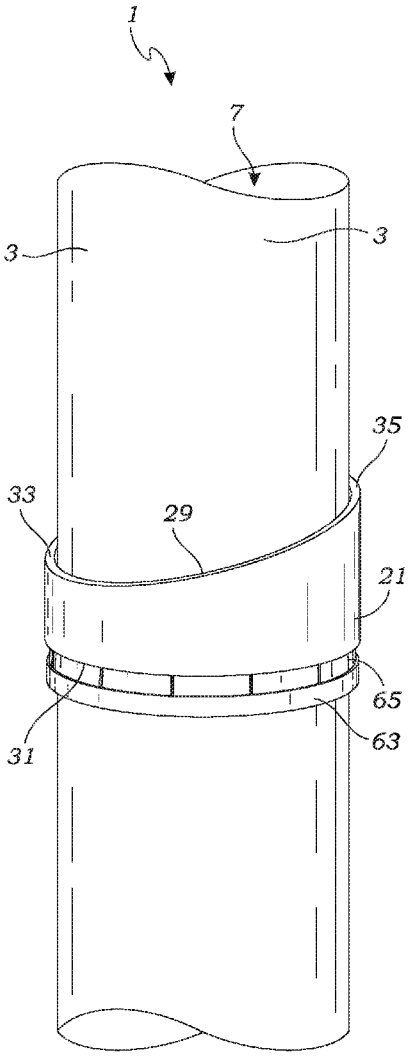
FIG. 6B is a perspective view of a pipe and collar assembly including the collar and compression ring shown in FIG. 6A.
Figure 7A:
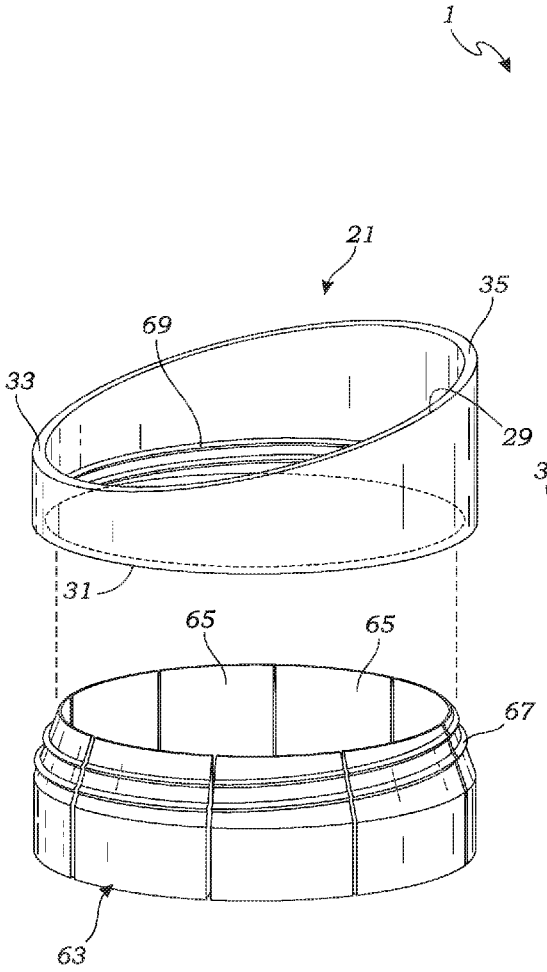
FIG. 7A is a perspective view illustrating a collar assembly threadably mountable to a compression ring.
Figure 7B:
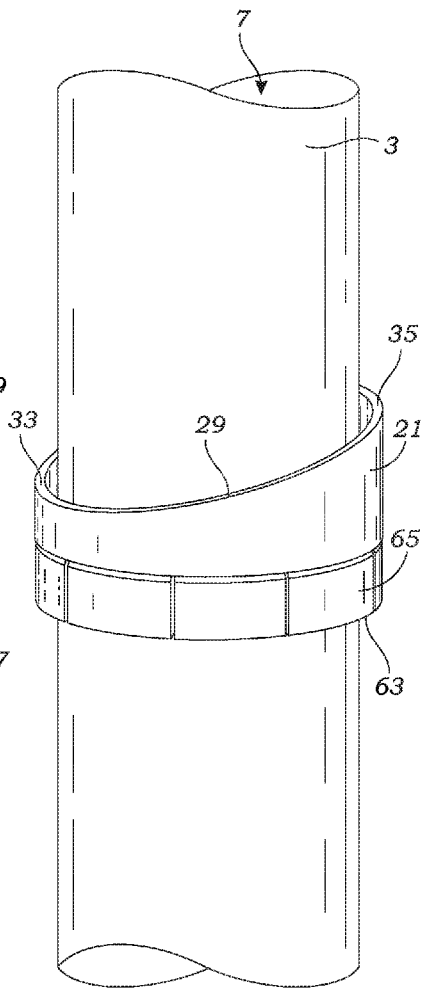
FIG. 7B is a perspective view of a pipe and collar assembly including the collar and compression ring shown in FIG. 7A.

In still an additional embodiment illustrated in FIGS. 6A and 6B, the stop collar 21 has an angled leading edge 29 and a trailing edge 31 perpendicular to the pipe 3. In addition, the stop collar assembly 1 includes a compression ring 63 which includes flanges 65 which project into the annular space between the stop collar 21 and pipe 3. The compression ring 63 may float within the stop collar 21, as illustrated in FIGS. 6A and 6B. Alternatively, the compression ring 63 may be affixed to the stop collar 21 such as by a press-fit engagement, tabs, straps, or any other fastener as can be determined by those skilled in the art. In a preferred embodiment, the stop collar 21 includes female threads 69 formed upon the stop collar's interior sidewall 25 for threadably receiving male threads 67 formed upon the compression ring's exterior sidewall, as illustrated in FIG. 7A and 7B.

Figures 8A, 8B:
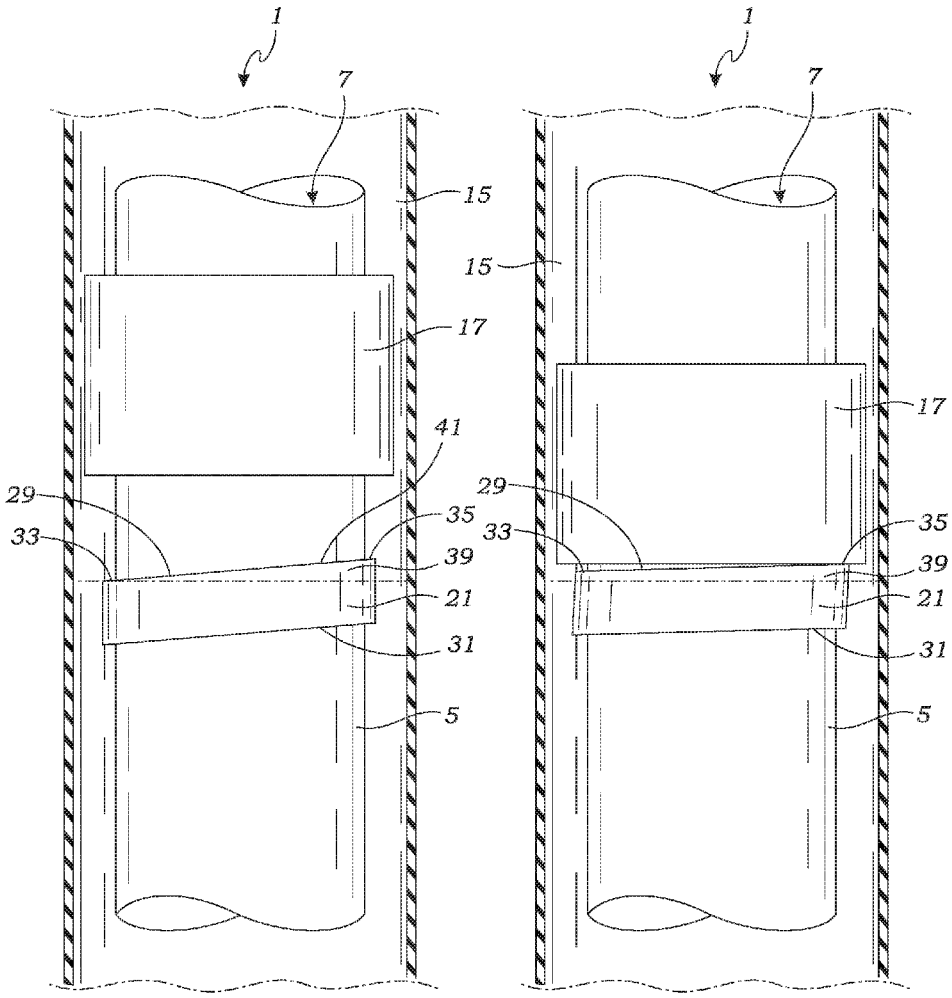
FIG. 8A is a side view of a pipe and collar assembly downhole in a wellbore.
FIG. 8B is a side view of the pipe and collar assembly downhole in a wellbore as illustrated in FIG. 8A wherein an object is causing the collar to cock relative to the pipe.

The pipe and collar assembly 1 offers numerous advantages. As illustrated in FIGS. 8A and 8B, the pipe and collar assembly 1 has particular application within a cylindrical wellbore 15. Typically the stop collar 21 is utilized in conjunction with another object 17, such as a tool or sensor. As illustrated in FIG. 8B, in the event that the object 17 is forced longitudinally into the stop collar 21, the object 17 will engage the stop collar's distal engagement point 35 causing the stop collar 21 to cock, and thereby causing the stop collar's proximal engagement point 33 to engage the pipe's sidewall 5. Further longitudinal force exerted by the object 17, will increase the breaking force of the stop collar and its engagement with pipe 3.

While particular forms of the invention have been illustrated and described, it will be apparent that various modifications can be made without departing from the spirit and scope of the invention. Therefore, it is not intended that the invention be limited to the specific embodiments illustrated. I described my invention in such terms as to enable a person skilled in the art to understand the invention, recreate the invention and practice it, and having presently identified the presently preferred embodiments thereof, I claim:

I claim:

1. A stop collar assembly and pipe combination comprising:

a longitudinally extending pipe having an annular sidewall and a central conduit defining a longitudinal axis;

a first stop collar having a circular body with a central hole, said first stop collar concentrically and coaxially receiving said pipe within its central hole, said first stop collar having a leading edge and a trailing edge, said leading edge being angled so as to not be perpendicular to said pipe's longitudinal axis so as to form an angled edge section having a proximal engagement point and a distal engagement point; and attachment means for attaching said first stop collar to said pipe to inhibit said first stop collar from moving longitudinally upon said pipe.

2. The stop collar assembly and pipe combination of claim 1 wherein said stop collar's leading edge is angled 1° to 45° from perpendicular to said longitudinal axis.

3. The stop collar assembly and pipe combination of claim 1 wherein said stop collar's leading edge is angled 1° to 10° from perpendicular to said longitudinal axis.

4. The stop collar assembly and pipe combination of claim 1 further comprising:

a second stop collar having a circular body with a central hole, said second stop collar concentrically and coaxially receiving said pipe within its central hole and positioned longitudinally adjacent to said first stop collar, said second stop collar having a leading edge and a trailing edge, said second stop collar's leading edge being angled so as to not be perpendicular to said longitudinal axis so as to form angled edge section having a proximal engagement point and a distal engagement point.

5. The stop collar assembly and pipe combination of claim 1 further comprising:

a ring concentrically and coaxially receiving said pipe within its central hole and positioned longitudinally adjacent to said first stop collar's leading edge, said ring having a circular body and a leading edge and a trailing edge wherein both of said ring's leading and trailing edges are perpendicular to said longitudinal axis.

6. The stop collar assembly and pipe combination of claim 1 wherein said attachment means includes a male threaded set screw projecting through a female threaded hole formed through the first stop collar's body, said set screw located substantially at the midpoint between said first stop collar's proximal engagement point and distal engagement point.

7. A stop collar assembly and pipe combination comprising: a longitudinally extending pipe having an annular sidewall and a central conduit defining a longitudinal axis; a first stop collar having a circular body with a central hole, said first stop collar concentrically and coaxially receiving said pipe within its central hole, said first stop collar having a leading edge and a trailing edge, said leading edge having a projecting region which projects longitudinally beyond the rest of said leading edge so as to provide said leading edge with a proximal engagement point and a distal engagement point so that engagement and force upon said distal engagement point by an object would cause said stop collar to cock relative to said pipe, wherein the proximal engagement point is not longitudinally aligned with the distal engagement point at any point on a circumference of the collar body; and attachment means for attaching said first stop collar to said pipe to inhibit said first stop collar from moving longitudinally upon said pipe.

8. The stop collar assembly and pipe combination of claim 7 wherein said stop collar's leading edge is straight and angled 1° to 45° from perpendicular to said longitudinal axis.

9. The stop collar assembly and pipe combination of claim 7 wherein said stop collar's leading edge is straight and angled 1° to 10° from perpendicular to said longitudinal axis.

10. The stop collar assembly and pipe combination of claim 7 further comprising:

a second stop collar having a circular body with a central hole, said second stop collar concentrically and coaxially receiving said pipe within its central hole and positioned longitudinally adjacent to said first stop collar, said second stop collar having a leading edge and a trailing edge, said leading edge having a projecting region which projects longitudinally beyond the rest of said leading edge so as to provide said leading edge with a proximal engagement point and a distal engagement point so that engagement and force upon said distal engagement point by an object would cause said stop collar to cock relative to said pipe.

11. The stop collar assembly and pipe combination of claim 7 further comprising:

a ring concentrically and coaxially receiving said pipe within its central hole and positioned longitudinally adjacent to said first stop collar leading edge, said ring having a circular body and a leading edge and a trailing edge wherein both of said ring's leading and trailing edges are perpendicular to said longitudinal axis.

12. The stop collar assembly and pipe combination of claim 7 wherein said attachment means includes a male threaded set screw projecting through a female threaded hole formed through the first stop collar's body, said set screw located substantially at the midpoint between said first stop collar's proximal engagement point and distal engagement point.

* * * * *